United States Patent [19]

Wider et al.

[11] Patent Number: 4,582,380

[45] Date of Patent: Apr. 15, 1986

[54] SPRING-PRESSURE CONNECTOR FOR ELECTRIC CONDUCTORS

[75] Inventors: Hans W. Wider; Manfred Wilmes, both of Detmold, Fed. Rep. of Germany

[73] Assignee: C. A. Weidmuller GmbH & Co, Detmold, Fed. Rep. of Germany

[21] Appl. No.: 528,761

[22] Filed: Sep. 2, 1983

[30] Foreign Application Priority Data

Sep. 9, 1982 [DE] Fed. Rep. of Germany ..... 3233457

[51] Int. Cl.[4] ..... H01R 4/02; H01R 11/22

[52] U.S. Cl. ..... 339/95 D; 339/262 R

[58] Field of Search ..... 339/74 R, 95 D, 262 R, 339/262 RR

[56] References Cited

U.S. PATENT DOCUMENTS 3,350,680 10/1967 Benoit et al. ..... 339/262 RR

FOREIGN PATENT DOCUMENTS 2503091 7/1976 Fed. Rep. of Germany .
2706988 8/1978 Fed. Rep. of Germany ... 339/95 D
2724354 11/1978 Fed. Rep. of Germany .
2730680 1/1979 Fed. Rep. of Germany .

*Primary Examiner*—Gil Weidenfeld
*Assistant Examiner*—Gary F. Paumen
*Attorney, Agent, or Firm*—Sprung Horn Kramer & Woods

[57] ABSTRACT

A spring-pressure connector for electric conductors having a clamp body and an associated movable spring having a longitudinal axis. A control surface and a control element engageable therewith are disposed on the clamp body and spring to enable the spring to move between a clamping position wherein an electrical conductor is held in place and a non-clamping position wherein an electrical conductor is insertable or removable in response to and simultaneous with sliding movement of the spring along its longitudinal axis relative to the clamp body.

17 Claims, 10 Drawing Figures

Fig. 8
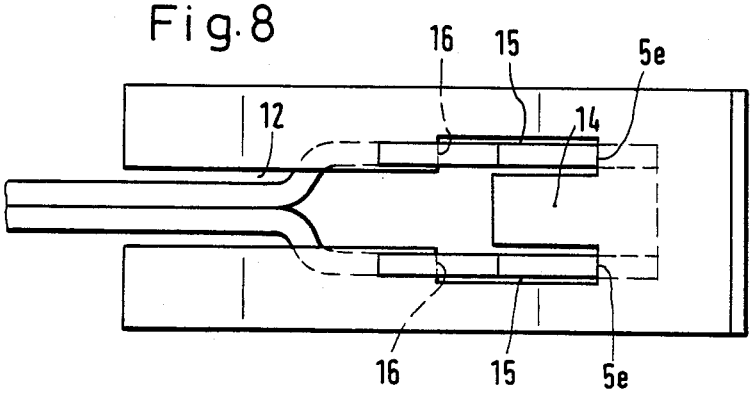
Fig. 9
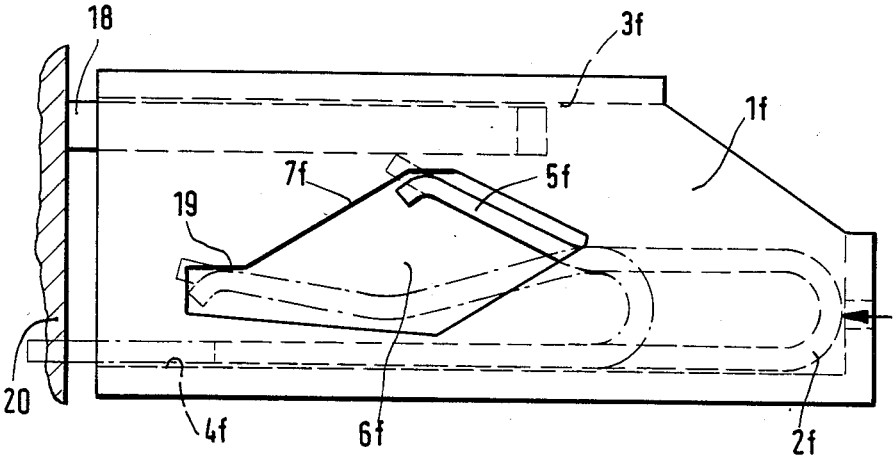
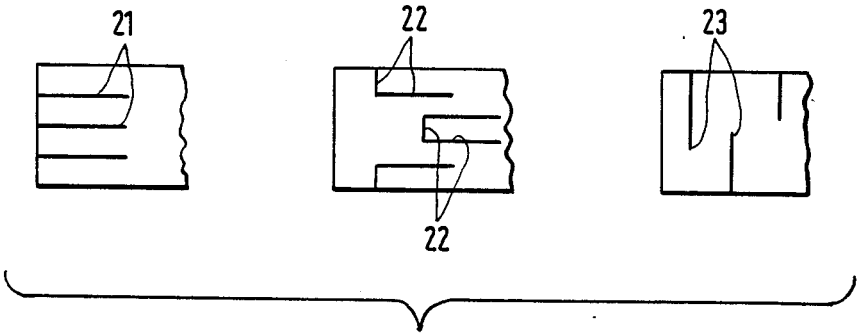
Fig. 10

SPRING-PRESSURE CONNECTOR FOR ELECTRIC CONDUCTORS

BACKGROUND OF THE INVENTION

The present invention relates to a spring-pressure connector for electric conductors having a clamp body and an associated movable spring that can be activated.

It is known to mount the conductor-clamping springs that secure the conductors essentially immovably in spring-pressure connector terminals for electric conductors on a clamp body in the form of a cage that is in one piece with the current-conducting part. Once the clamp connection has been established, it can either be released with separate activating elements mounted in the terminal housing as shown in German OS No. 2 730 680 or the housing has recesses facing toward the clamping position for the introduction of an activating tool like a screwdriver as shown in German OS No. 2 724 354. Both types necessitate space for the activating elements that will not be available when such connectors are to be employed for multiple-pole, multiple-row connector strips or similar devices.

A spring-pressure connector terminal in which the spring is mounted in such a way as to rotate with respect to the clamp cage to release the connection to a conductor is also known from German OS No. 2 503 091. The spring is rotated into and locked in its contact position after the conductor has been introduced. The assembly and activation of a spring of this type necessitate quite a bit of space.

SUMMARY OF THE INVENTION

The object of the present invention is accordingly to provide a spring-pressure connector of a general type that requires especially little space not only to accommodate but to activate in order to release the connection.

This objective is attained in accordance with the present invention by a connector wherein the spring thereof is mounted in such a way as to slide parallel to its own axis on the clamp body and has at least one control piece for which there is a control surface on the clamp body which opens and closes the connection simultaneous with and in response to the sliding movement of the spring.

Since the spring slides parallel to its own axis, it can always be activated from in front, that is, from the side where the conductor is inserted, and very little space will be required both for the spring itself and especially little space for the activating tool, which normally will extend only very slightly beyond the space that will be required at any rate for inserting the conductor. The control piece and control surface can be kept small in view of the opening forces that must be exerted, which will also only slightly increase the the space taken up by the connector.

In one preferred embodiment of the connector, a catch is disposed between the clamp body and the spring for the clamping position of the spring. In another embodiment, a retaining surface for maintaining the spring ready to operate when the connector is in the open position is adjacent to the surface that controls the release motion of the spring. Preferably, the securing end of the spring has transverse and/or longitudinal slits. Further, the securing end of the spring is bent into a position in which it is at least partly parallel to the clamping surface of the clamp body.

In a further preferred embodiment, the clamp body is shaped like a housing and the spring is essentially accepted in it. The clamp body is preferably made of an electrically conducting material and is part of a current-conducting component or the clamp body is made of an electrically insulating material and the spring is part of an electric circuit.

Moreover, the clamp body is preferably designed to accept electric contacts. At least one side wall of the clamp body preferably has a recess that is bounded on one side by a sloping control surface and wherein at least one side of the spring has a control piece that projects into the recess and operates in conjunction with the control surface. The control surface of the recess is preferably positioned on the side of the recess that faces the open front, the securing end of the spring has at least one lateral control projection, and the spring is supported in the clamp body in such a way that it can be extracted parallel to its own axis to release the connection. The lower front area of the clamp body is preferably left open and notches that open downwards and accept lateral snap-in projections on the spring when the connector is in the clamping position are worked into the bottom edges of the lateral walls of the clamp body.

The sloping control surface is preferably on the side of the recess that faces the open front and the spring has a lateral control bracket that projects as a control piece into the recess, with the spring capable of being displaced into the position that releases the connection by being slid parallel to its own axis into the clamp body.

A sloping control bracket is preferably provided, that projects inward and contains the control surface and is punched out of one side wall of the clamp body and is accepted by a recess in the spring with an outline that constitutes the control piece.

In a preferred embodiment, the spring is in two parts, one part having the securing end and the control piece and the second forcing the first against the clamping surface of the clamp body. The spring is preferably also controlled by a section projecting from the clamp body against a section of a housing made of insulating material that encloses the clamp body.

The lower area of one side wall of the clamp body is preferably left open and there is a sloping control surface on the free bottom edge of the side wall that is engaged by an offset control edge that serves as a control piece on the spring.

In a still further preferred embodiment, the clamp body is a rod-shaped casting along which the spring has perforations that accept the rod-shaped body, slides parallel to its own axis. The area of the clamp body that operates in conjunction with the spring preferably has a U-shaped cross-section, its free end has backward-sloping tabs with the sloping control surface on one of their bounding sides, the spring is bent back flat on itself and has a central admitting slot for the clamp body and a clamping bracket that points toward the floor of the U that forms the clamping surface of the clamp body, both sides of the clamping bracket having laterally offset recesses that the tabs extend through and one floor of the recess always forming a control piece that operates in conjunction with the control surfaces. The other floor of the lateral recesses in conjunction with the rear slopes of the tabs preferably constitutes a means of preventing the conductor from being pulled out. Moreover, there is preferably a small recess in the clamping surface of the clamp body that faces the securing end of spring when the spring is in the clamping position.

The embodiments with special control surface sections that allow the connector to be maintained ready in a particular open position or that reinforce the clamping action when there is a pull on the conductor to prevent accidental release of the connection are of particular importance. Also of importance is the potential afforded by an additionally activated catch and by a special multiple-piece spring to improve the application of force to the conductor as well as means that ensure that the spring will slide smoothly in its rest position when a slender-wire conductor is introduced. A spring-pressure connector that operates on this principle absolutely does not have to be in the form of a cage that clamps down on the parts of the current conductor. The contact points can basically be of any desired shape. Even flat plugs can, for example, easily be employed with a connector of this type, which means extraordinary simplification with respect to the crimp connectors often employed with flat plugs. It is especially the potential for employment with flat plugs that is promoted by the exceptionally low space requires of such a connector.

Some preferred embodiments of the invention will now be specified by way of example with reference to the drawings, in which

BRIEF DESCRIPTION OF THE DRAWINGS

FIG. 8 is a top view of the connector in FIG. 7, FIG. 9 is a simplified side view of a spring-pressure connector for flat plugs in accordance with the invention, and FIG. 10 shows partial top views of various versions of the securing ends of springs intended for connectors of this type.

DETAILED DESCRIPTION OF THE INVENTION

Figure 2:
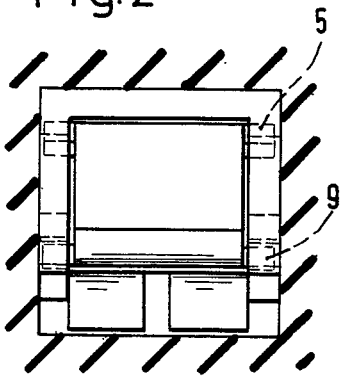
FIG. 2 is a simplified rear view of the connector in FIG. 1.
Figure 1:
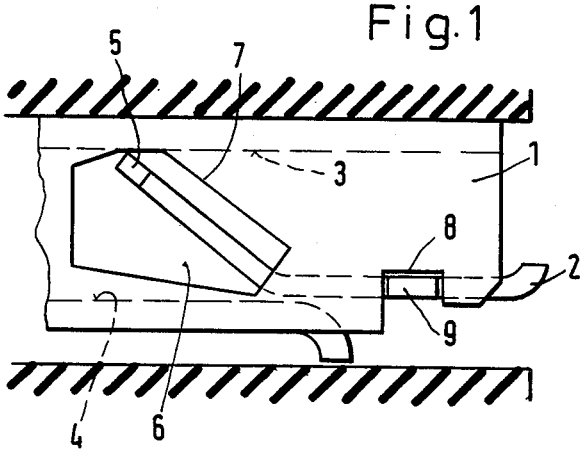
FIG. 1 is a simplified side view of a spring-pressure connector in accordance with the invention.

In the embodiment illustrated in FIG. 1, a spring 2 in the form of a bent piece is inserted to slide parallel to its own axis in a clamp body 1 having the shape of a clamp housing. Opposite the clamping surface 3 of housing-shaped clamp body 1 is a counterbearing surface 4 that spring 2 can rest against in the clamping position.

This embodiment has two control pieces in the form of lateral projections 5 on spring 2 and two recesses 6 in the side walls of housing-shaped clamp body 1 that accept the projections. Recesses 6 are designed to simplify the installation of spring 2 and also have control surfaces or contours 7 that are positioned parallel to each other in the path traveled by lateral projections 5 in such a way that when spring 2 moves the clamping end of spring 2 will be forced away from the clamping surface 3 of clamp body 1, releasing the connection. The connection is released in the embodiment illustrated by displacing spring 2 slightly out of clamp body 1.

This embodiment has a separate locking mechanism to ensure maintenance of the clamping position. There are downwards-facing notches 8 in the initial section, which is kept open facing downwards, of the side walls of clamp body 1 and lateral snap-in projections 9 in the corresponding section of spring 2 that engage notches 8 when the spring is in the clamping position as illustrated in FIG. 1. Before the connection can be released, the front end of spring 2 must be forced down until until lateral snap-in projections 9 leave notches 8. As spring 2 is subsequently retracted to release the connection, snap-in projections 9 will come into contact with the surface of the lower free edges of the side walls of housing-shaped clamp body 1 and lateral projections 5 will come into contact with sloping control contours 7.

Figure 3:
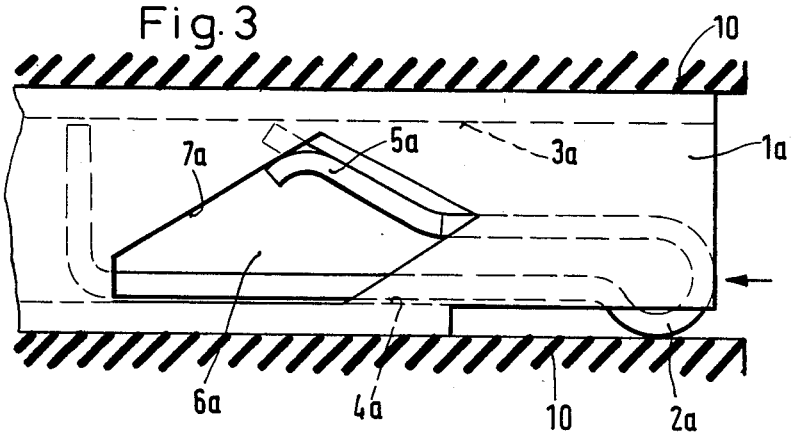
FIG. 3 is a simplified side view of a similar connector.

The embodiment illustrated in FIG. 3 is basically similar to that illustrated in FIG. 1. The side wall of clamp body 1*a* has a recess 6*a* with a sloping control contour 7*a* that operates in conjunction with the curved end of a control piece in the form of a bracket 5*a* projecting from the side of spring 2*a*. The securing end of spring 2*a* also operates in conjunction with clamping surface 3*a*. In the clamping position the spring rests against the counterpressure surface 4*a* of clamp body 1*a*. This spring is bent back against itself around an exterior angle.

The connection is again released from the open front by pressing slightly in the direction indicated by the arrow on the bend of spring 2*a*, displacing it slightly into clamp body 1*a* so that the curved end of control bracket 5*a* travels down along the sloping control contour 7*a* and the securing end of spring 2*a* will be forced away from clamping surface 3*a*. During this displacement the bend in spring 2*a* can also be guided along the housing 10 of insulating material that encloses clamp body 1*a*.

Figure 4:
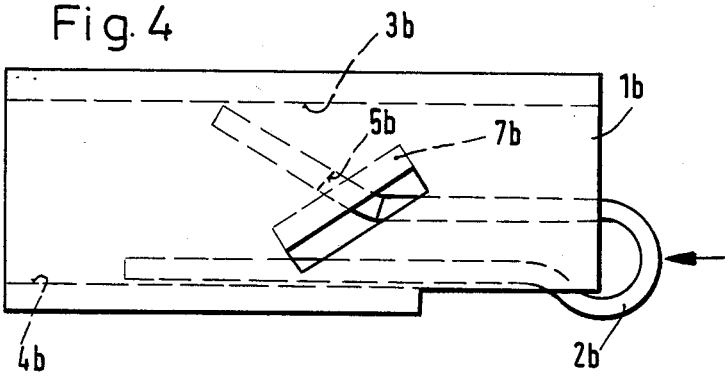
FIG. 4 is a simplified side view of another similar connector.

The control contour in the clamp body 1*b* of the embodiment illustrated in FIG. 4 is made up of a bracket 7*b* punched out of at least one side wall of the body and bent inward at a predetermined angle and of a recess 5*b* at a corresponding point in each side of the spring 2*b*, which is again bent back on itself, that engages the sloping bracket so that, when the connection is released by pressing the spring into the clamp body, the affected wall of recess 5*b* will travel along bracket 7*b*, again forcing the securing end of spring 2*b* off of clamping surface 3*b*. Spring 2*b* again rests against the counterbearing surface 4*b* of clamp body 1*b*.

Figure 5:
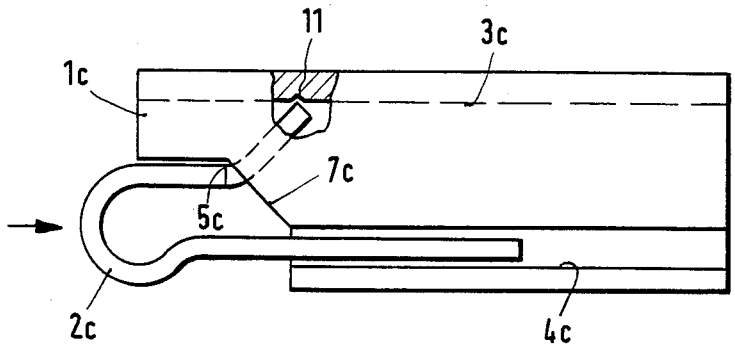
FIG. 5 is a simplified side view of another embodiment of this type of connector.

In the embodiment illustrated in FIG. 5, the lower area of the limiting wall of the clamp body 1*c* that is adjacent to counterbearing surface 4*c* is open. There is a sloping control surface 7*c* at the front of the open lower edge of this wall.

Spring 2*c* is again bent back on itself and both the leg of the spring that operates in conjunction with counterbearing surface 4*c* and its bend are wider than clamp body 1*c*. The spring has a narrower section subsequent to an offset control edge 5*c* and forming its securing end, which extends into clamp body 1*c* up to its clamping surface 3*c*.

This connection is also released by pressing slightly on the bend in the front of spring 2*c* to displace into clamp body 1*c* so that the offset control edge 5*c* will slide down along control surface 7*c*, forcing the securing end of the spring off the clamping surface 3c of clamp body 1c.

An electric conductor that is to be connected can easily be inserted in a spring-pressure connector of this type if its metal core is massive enough to force the securing end of the spring back without difficulty. If, however, a conductor with a slendor core is to be connected with a spring-pressure connector of this type, it is very easy to do so by displacing the spring slightly with an activating tool in the release direction to lift the securing end of the spring off the clamping surface of the clamp body, easily inserting the conductor, and then allowing the spring to spring back into the clamping position. Under certain conditions, however, there can be problems in displacing the spring into the release position, especially when the connector has been designed with a relatively powerful clamping force and the securing end accordingly presses relatively forcefully against the clamping surface of the clamp body even in the release position, which can cause it to get stuck in that position. This is avoided in the embodiment illustrated in FIG. 5 by a very small recess 11 at the clamping point of clamping surface 3a. Recess 11 must be just large enough to prevent the adjacent edge of the securing end of spring 2c from getting caught.

Figure 6:
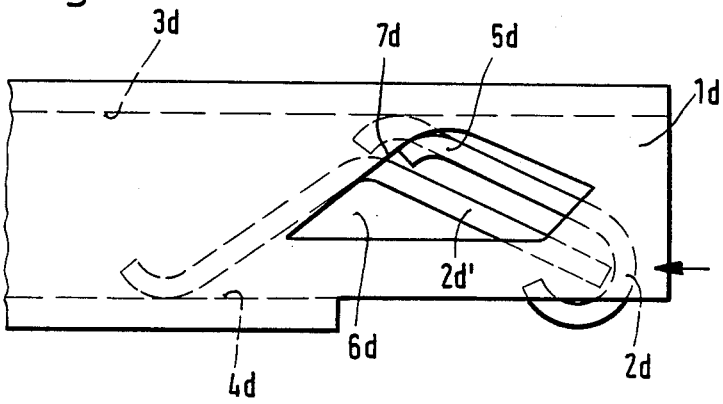
FIG. 6 is a simplified side view of still another embodiment of this type of connector.

The embodiment illustrated in FIG. 6 has the special feature of a two-part spring. The front end of one part 2d is again bent over on itself while the other end is curved and operates in conjunction with the clamping surface 3d of clamp body 1d. The section of part 2d that operates in conjunction with the control surface 7d in a recess 6d in clamp body 1d also has a laterally projecting curved control bracket 5d. One end of the second part 2d' of the spring rests against the inside of the bend in part 2d, its other end against the the counterbearing surface 4d of clamp body 1d, and the apex of its bent section against the securing end of spring part 2d. Part 2d' can be designed to generate a powerful clamping force that will also allow part 2d to be designed with beneficial surface characteristics just at the securing end, at that point in other words where contact force is applied.

The embodiments described in the foregoing are based on a concept in which the clamp body is at least essentially shaped like a cage or housing and accepts at least the essential part of the spring. It is, however, also possible to design a spring-pressure connector in which the spring is displaced parallel to its own axis while its securing end is lifted from the clamping surface of the body of the clamp to release the connection in accordance with a quite different principle. In the spring-pressure connector illustrated in FIGS. 7 and 8 for example, the body 1e of the clamp is shaped essentially like a rod that extends partly through spring 2e and that the spring slides along parallel to its own axis. One end of such a clamp body 1e can for example be securely clamped in a mount, providing great freedom in relation to demands with respect to the housing aspects of securing the body. The body does not in particular now need to be more or less of a cage mounted on the current-conducting part of a clamp connector.

Figure 7:
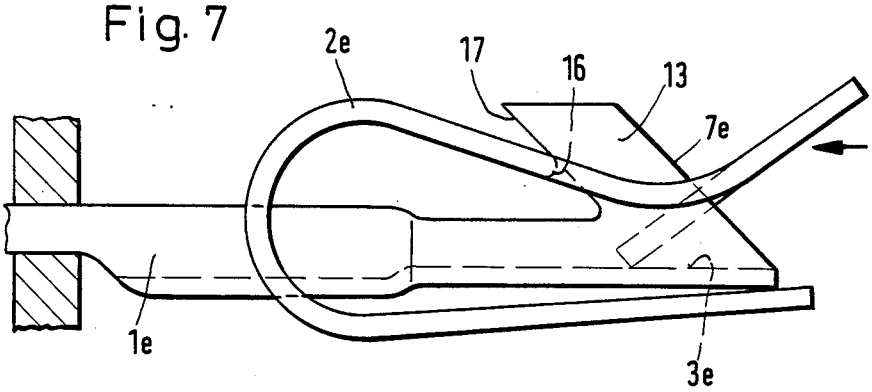
FIG. 7 is a side view of another spring-pressure connector in accordance with the invention.

In the embodiment illustrated in FIGS. 7 and 8, spring 2e is bent back flat against itself and has a slotted recess 12 in its midsection that extends from the lower leg through almost all of the bend. The sections of clamp body 1e that operate in conjunction with spring 2e can penetrate through this recess. The cross-section of the front end of clamp body 1e is more or less U-shaped and the same end has tabs 13 that slant up from front to back.

A bracket 14 is left at the end of slotted recess 12 in the exiting end of of the bent section of spring 2e, extending the curved end of the bend inward. Bracket 14 extends to the base of the U-shaped end of clamp body 1e. This bracket constitutes the securing end of the spring, and the base of the U-shaped section constitutes the clamping surface 3e of the body.

The slotted recess 12 in spring 2e has laterally offset expansions 15 on both sides of bracket 14 through which the two tabs 13 on clamp body 1e can extend. The terminal edges 5e of these lateral expansions 15 will then rest against the sloping front control surfaces 7e of the tabs 13 on clamp body 1e. If, then, pressure is applied on the bent-up upper end of spring 2e from the front in the direction indicated by the arrow in FIG. 7, the spring will be displaced parallel to its own axis along body 1e, lifting the lower securing end of bracket 14 off of clamping surface 3e because the terminal edges 5e of the laterally expanded recesses 15 which function as the control pieces will be guided up along the front edges 7e of the tabs 13 which function as control surfaces.

This embodiment also has another simple means of reliably preventing the conductor from being ripped out unintentionally. The device is designed so that the rear offset edges 16 of laterally expanded recesses 15 rest against the sloping rear edges 17 of the two tabs 13. If the conductor is tugged in the direction in which it would be ripped out, edges 16 will tend to migrate down along slopes 17 and hence for bracket 14 to force the spring even more tightly against the inserted conductor.

In all the embodiments described in the foregoing, the electric conductor that is to be connected is a massive or slender wire and the body of the clamp is made of an electrically conducting material. Various types of contact devices can, however, be equipped with a spring-pressure connector of this type. Thus, the embodiment illustrated in FIG. 9 is intended for flat plugs. The body 1f of the clamp is made in this case of an electrically insulating material and the spring 2f constitutes the electrically conducting part. There is a recess 6f in the side wall of clamp body 1f into which a control bracket 5f on the side of the particular leg of spring 2f fits. The free curved end of the bracket operates in conjunction with the control surface 7f of recess 6f. Spring 2f on the one hand rests against the counterpressure surface 4f of clamp body 1f and its securing end engages a flat plug 18 when the latter is inserted in clamp body 1f and against its clamping surface 3f. The plug can be retracted when pressure is applied from behind against the bend of spring 2f to release the connection because the control surface 7f will then be forcing control bracket 5f down and the securing end of the spring will also simultaneously be forced down, releasing the plug.

This embodiment also permits the manufacturer to supply an open clamp connector that is designed to accept a flat plug. For this reason there is a retaining surface 19 in recess 6f adjacent to the lower end of control surface 7f parallel to the base line formed by counterbearing surface 4f. The manufacturer can now mount spring 2f in clamp body 1f in such a way that retaining surface 19 will forcibly maintain the securing end of spring 2f off the clamping area above the control bracket 5f that has been inserted under surface 19. This system is designed so that in this position the free front end of the leg of spring 2*f* that travels along counterbearing surface 4*f* projects slightly out of clamp body 1*f*. When pressure is applied to clamp body 1*f*, spring 2*f* will be displaced under stops on rear wall 20 until it leaves the area of retaining surface 19 and closes by expanding.

Considering that the spring must be displaced parallel to its own axis to release the connection, it is practical to design the securing end of the spring so that satisfactory contact is established not so much as the result of powerful spring force but rather as the result of satisfactory geometric matching with the conductor to ensure that the securing end of the spring will not get caught on the conductor and impede or even prevent displacement. FIG. 10 illustrates schematically three different possibilities for designing the securing ends of some particular springs. The rigid end of the springs is made more flexible by longitudinal and/or transverse slits 21, 22, and 23. This flexibility always ensures that the securing end of the spring will adapt itself better to the conductor, the securing end then being squared off, if not indeed rounded off as suggested in connection with the embodiment illustrated in FIG. 6. Another advantage of this embodiment is that a spring that is slit in this way will contact the conductor at several points, resulting in more points to resist accidentally pulling it out. Still another advantage of this design is that movements on the part of the conductor will not directly affect the sharp terminal edge of the spring.

It will be appreciated that the instant specifiation and claims are set forth by way of illustration and not limitation, and that various modifications and changes may be made without departing from the spirit and scope of the present invention.

What is claimed is:

1. A spring-pressure connector for electrical conductors, comprising: a clamp body comprising a housing having a front opening for receiving an electrical conductor; spring means configured to be received in the housing through the front opening and having a clamping portion and a longitudinal axis and mounted for sliding movement along its longitudinal axis with respect to the clamp body, wherein the spring means via the front opening is manually displaceable parallel to its longitudinal axis away from the front opening; and control means disposed on the clamp body and the spring means and including at least one control surface and control element engageable therewith for moving the clamping portion of the spring means in response to and simultaneously with the manual displacement of the spring means, between a clamping position wherein an electrical conductor inserted through the front opening is held in place between the clamping portion and the clamp body and a non-clamping position wherein an electrical conductor is insertable or removable through the front opening in response to and simultaneous with the longitudinal sliding movement of the spring means.

2. The spring-pressure connector as in claim 1 further comprising means forming a catch between the clamp body and the spring means for releasably retaining the spring means in the clamping position.

3. The spring-pressure connector as in claim 1, wherein the control means further comprises a retaining surface for releasably maintaining the spring means in the non-clamping position and ready to operate and wherein the retaining surface is adjacent the guide surface.

4. The spring-pressure connector as in claim 1, wherein the clamping portion of the spring means comprises a securing end having one of transverse and longitudinal slits.

5. The spring-pressure connector as in claim 1, wherein the clamp body has a clamping surface and the clamping portion of the spring means comprises a securing end bent into a position in which it is at least partly parallel to the clamping surface of the clamp body.

6. The spring-pressure connector as in claim 1, wherein the clamp body is made of an electrically conductive material.

7. The spring-pressure connector as in claim 1, wherein the clamp body is made of an electrically insulating material and the spring means is made of an electrically conductive material.

8. The spring-pressure connector as in claim 1, wherein the clamp body is configured to receive an electric contact.

9. The spring-pressure connector as in claim 1, wherein the housing has at least one side wall and the control means comprises a recess in the at least one side wall that is bounded on one side by a sloping surface to form the control surface and wherein the control element comprises a control projection on at least one side of the spring means that projects into the recess and operates in conjunction with the control surface.

10. The spring-pressure connector as in claim 9, wherein the control surface of the recess is positioned on the side of the recess that faces the front opening of the housing, wherein the spring means has a securing end having at least one lateral control projection, and wherein the spring means is supported in the housing for movement parallel to its own axis into the non-clamping position.

11. The spring-pressure connector as in claim 2, wherein the lower front area of the housing is open and wherein the catch comprises notches in the housing that open downwards and lateral snap-in projections on the spring means which engage the notches when the spring means is in the clamping position.

12. The spring-pressure connector as in claim 9, wherein the sloping control surface is on the side of the recess that faces the front opening and wherein the control projection of the spring means comprises a lateral control bracket that projects as a guide piece into the recess.

13. The spring-pressure connector as in claim 1, wherein the housing has side walls and wherein the control means comprises a sloping control bracket in one side wall that projects inwardly and forms the control surface and recess in the spring means that receives the control bracket and that forms the control element.

14. The spring-pressure connector as in claim 1, wherein the spring means comprises two parts, the clamping portion having a securing end and the control element, and the second part forcing the clamping portion against a clamping surface of the clamp body.

15. The spring-pressure connector as in claim 1, wherein the housing is an insulating housing having a portion for guiding the sliding movement of the spring means.

16. The spring-pressure connector as in claim 1, wherein the housing has side walls and the lower area of one side wall of the housing is open and the control means comprises a sloping control surface on the free bottom edge of the one side wall engaged by an offset control edge on the spring means that forms the control element.

17. The spring-pressure connector as in claim 1, wherein the clamping portion of the spring means comprises a securing end and the clamp body has a clamping surface and a small recess in the clamping surface of the clamp body facing the securing end of the spring means when the spring means is in the clamping position.

* * * * *